US006589046B2

(12) United States Patent
Harneit

(10) Patent No.: US 6,589,046 B2
(45) Date of Patent: Jul. 8, 2003

(54) GAS BURNER FOR OUTDOOR COOKING

(76) Inventor: Uwe Harneit, 1466 West Francis Avenue, Ontario, CA (US) 91762-6016

( * ) Notice: Subject to any disclaimer, the term of this patent is extended or adjusted under 35 U.S.C. 154(b) by 0 days.

(21) Appl. No.: 10/188,606

(22) Filed: Jul. 2, 2002

(65) Prior Publication Data

US 2003/0039935 A1 Feb. 27, 2003

Related U.S. Application Data

(60) Provisional application No. 60/313,951, filed on Aug. 21, 2001.

(51) Int. Cl.[7] ..... F24C 3/08; F23D 14/06; F23D 14/72

(52) U.S. Cl. ..... 431/266; 431/354; 431/349; 126/39 E; 126/39 BA

(58) Field of Search ..... 431/349, 354, 431/266, 286; 126/39 R, 39 E, 39 BA, 41 R; 239/552, 556, 559, 567

(56) References Cited

U.S. PATENT DOCUMENTS

| | | | | |
|---|---|---|---|---|
| 5,323,759 A | | 6/1994 | Hammel et al. | |
| 5,468,145 A | | 11/1995 | Ferlin | |
| 5,623,917 A | | 4/1997 | Dinaso et al. | |
| 5,704,777 A | | 1/1998 | Measom | |
| 5,865,615 A | | 2/1999 | Simpson et al. | |
| 5,924,860 A | * | 7/1999 | Massey et al. | 431/266 |
| 6,067,978 A | * | 5/2000 | Schlosser et al. | 126/41 R |
| 6,146,132 A | | 11/2000 | Harneit | |
| 6,332,460 B1 | * | 12/2001 | Paesani | 126/39 R |

FOREIGN PATENT DOCUMENTS

| | | | | |
|---|---|---|---|---|
| DE | 31 23751 | * | 6/1981 | 431/354 |
| EP | 392 523 | * | 10/1990 | 431/354 |
| EP | 634608 | * | 1/1995 | 431/266 |
| EP | 964 203 | * | 12/1999 | 126/39 E |
| EP | 1 162 404 | * | 12/2002 | 431/354 |
| GB | 2 272 283 | * | 5/1994 | 431/354 |
| SU | 1615465 | * | 12/1990 | 431/354 |

* cited by examiner

*Primary Examiner*—Carl D. Price
(74) *Attorney, Agent, or Firm*—Lewis M Brande; Thomas A. McCleary; Brande & McCleary

(57) ABSTRACT

A multi piece gas burner assembly that is machined or cast and having a burner base that contains holes for primary air where the hole dimensions do not exceed the height of a jet mounted therein. The burner base is fastened onto an appliance. The burner head rests upon a boss on the burner base and has a tube that directs a flammable gas-air mixture from the burner base into a cavity created between the burner head and the burner cap. The burner cap rests upon the burner head and contains an outer edge that is turned downwards in order to allow fluid to drip away from the flame. A groove is cut into the burner cap just inside the down turned outer edge and provides a location for a support flame. The location of the groove prevents fluid and dust from collecting inside the groove. The groove captures the flammable gas-air mixture, which provides a constant ignition source for the gas-air mixture through slots in the burner cap when ignited.

This improved version of a multi piece gas burner assembly has simplified parts and has locating bosses moved to the outer edge of the gas burner assembly for simpler fixing of the components. Also, the burner cap now overlaps and rests on the burner head, which is simpler than using locating detents. Also, a multiplicity of larger and smaller holes drilled through an annular burner ring attached to the burner head improve the operation of the burner in extremely cold temperatures.

6 Claims, 4 Drawing Sheets

GAS BURNER FOR OUTDOOR COOKING

This application claims the benefit of Provisional Appln. No. 60/313,951 filed Aug. 21, 2001.

CROSS-REFERENCES TO RELATED APPLICATION

Applicant hereby makes reference to patent application Ser. No. 09/374,456, filed Aug. 14, 1999, now U.S. Pat. No. 6,146,132, issued Nov. 14, 2000 for "Gas Burner for Outdoor Cooking".

BACKGROUND OF THE INVENTION

1. Field of the Invention

Multi-part gas burners that are used for outdoor cooking, for instance as so-called side-burners on barbeques, normally need to be dismantled and cleaned before they can be ignited after a rain. This is due to the fact that multi-part gas burners predominately have an indentation in the burner base to receive and center the so-called burner ring and rain water, and/or dirt particles collect in this indentation.

Normally these burners have a smaller flame ring underneath the main flame port openings. This smaller flame ring serves as a sort of a support flame for the main flame. This support flame prevents the main flame from being separated from the burner. Customarily the relatively small amount of gas for the support flame is conducted from the side, or from below through the walls or below the walls, from a groove going around in the burner ring resting in the burner base to the outside.

A primary disadvantage of burner designs of this sort, is that the openings for this ring of support flame, also called auxiliary gas, which goes around the outside of the burner, can become clogged with rain water or dirt particles. When the ring is clogged in this manner the normal result is that the burner cannot be re-ignited without first cleaning the openings of dirt and/or rain water. A further disadvantage with the burners currently found on today's market is that they are quite difficult to clean, since their design makes dismantling difficult if not complicated.

In burners found in today's market, the current method of supplying primary air to the burner jet which creates a flammable gas-air mixture, presents an additional problem, or requires a special technology to supply primary air. The additional problem is the size of the hole in the jet. This is a problem because, the size of the hole in the burner jet is pre-set for the maximum necessary flow of gas for the maximum burner output. The maximum flow for the maximum burner output is basically too great a gas flow for the lower settings of the burner. At present, this is unavoidable from a design standpoint, and results in the flow pressure of the lesser amount of gas for the low setting being much less than for the maximum setting. Since this gas flow jet is installed below the actual burner and is thus exposed to wind from the side, it frequently occurs that the flow of gas through the jet is displaced sideways, and the burner goes out.

In order to prevent this sideways displacement of the flow of gas from the jet, other burner designs for this reason, have provided the jet with a round, closed housing (burner base) in the lower part of the burner. By designing the burner base in this manner, the drawing of primary air now is from above the edge of the closed housing surrounding the jet and downward. Even in this type of design a side wind can cause rain water to penetrate into the housing over the upper edge.

If sufficient rainwater collects, this would close the relatively small hole in the gas flow jet. The current procedure to prevent water and dirt from accumulating in the burner base is the introduction of a so-called rain-runoff opening (hole) in the base of the housing. This provides a passageway for the rainwater and dirt that normally accumulate in the burner base which is customarily closed in the base and side walls.

2. Description of the Prior Art

The use of a multi-part gas burner is known in the prior art.

Prior art U.S. Pat. No. 6,146,132, by the same inventor as in this applications, reveals a multi piece gas burner assembly that is machined or cast and has a burner base that contains holes for primary air where the hole dimensions do not exceed the height of a jet mounted therein. The burner base is fastened onto an appliance. The burner head rests upon a boss on the burner base and has a tube that directs a flammable gas-air mixture from the burner base into a cavity created between the burner head and the burner cap. The burner cap rests upon the burner head and contains an outer edge that is turned downwards in order to allow fluid to drip away from the flame. A groove is cut into the burner cap just inside the down turned outer edge and provides a location for a support flame. The location of the groove prevents fluid and dust from collecting inside the groove. The groove captures the flammable gas-air mixture, which provides a constant ignition source for the gas-air mixture through slots in the burner cap when ignited.

Prior art U.S. Pat. No. 5,865,615 discloses an improved burner for a gas range used in the home. The basis of this invention is to provide an improved capability for the owner of this type of burner to clean the range without using special tools, as was necessary prior the to creation of the invention disclosed in this patent.

Prior art U.S. Pat. No. 5,704,777 discloses an improve gas burner for cooking in outdoors settings. The purpose of this invention is to provide improved resistance to the effects of winds that typically could cause a disruption of the flame. This invention discloses a burner screen that allows the air-fuel mixture, which is sub-stoichiometric in nature, to pass through the screen and mix with surrounding ambient air, thus creating a stoichiometric air-fuel mixture that will burn. The burner screen is protected from ambient wind currents by being installed within a burner cup, which is sub flush to the top surface of the burner cup. When a cooking pot is used on the burner, it helps to significantly reduce the effects of wind on the burner's flame.

Prior art U.S. Pat. No. 5,623,917 discloses a gas burner assembly that is easily removed and is secured to the top panel of a range by using a mounting bracket, which locks the burner assembly in place and prevents rotation of the burner assembly.

Prior art U.S. Pat. No. 5,468,145 discloses a sealed gas burner that has an improved spark ignition system that will eliminate the problem of a non-consistent spark, which increases the reliability of ignition of the air-gas mixture. An additional benefit of this invention is the protection of the igniter electrode from damage due to food spills.

Prior art U.S. Pat. No. 5,323,759 discloses a sealed gas burner mounting assembly which allows easy assembly, disassembly, and adjustment of the burners after maintenance has been performed. The patent also discloses one piece burner heads with integral gas pipes affixed onto them.

SUMMARY OF THE INVENTION

The purpose of the present invention is to provide a burner assembly that has improved resistance to dirt and moisture intrusion into the supporting flame groove of the burner assembly.

It is a further purpose of the invention to provide an improved burner assembly that can operate efficiently at low temperature settings in 10 mile per hour (MPH) winds.

Another purpose of the invention is to provide an improved burner assembly that is capable of operating in a rainy environment without extinguishing the flame.

The present invention consists of a multi-piece burner assembly which is comprised of a cast, or machined burner base, which is attached to an appliance top using screws, rivets or other mechanical fastening means. The upper portion of the burner assembly, which is named a burner head, consists of a cast or machined structure that provides a passage for a gas-air mixture from the burner base to the top surface of the burner head. The burner head is designed to overlap the burner base and is loosely attachable by being positioned with a multiplicity of cut-outs to a complementary multiplicity of bosses integral to the burner base.

The top of the burner assembly consists of a burner cap or flame spreader cap. The burner cap consists of a groove for a support flame, a lip that allows liquid to drip away from the support flame groove, an annular ring that provides a multiplicity of large and small holes for flame and an additional boss for the burner cap to connect with the upper portion of the burner assembly.

This invention is an improvement over U.S. Pat. No. 6,146,132. The improvements include substantially simplifying the parts and making the alignment of the parts visible to the end user by relocating the positioning bosses to the outer edge of the burner assembly.

In addition, the burner cap completely overlaps the outer edge of the burner head, instead of positioning it in place with small detents as in U.S. Pat. No. 6,146,132, which makes positioning of the burner cap simpler.

A third advantage of the current invention is that small and large holes are drilled in an annular burner ring's wall on the outer edge of the flame spreader cap. The small holes are provided to support the flame in a "cold" burner (e.g. in winter time at −30° F.) so that the flames don't tend to tear off around the edge. By means of rapid warming in the zone of these small holes, it is assured that the flames from the larger holes located above the smaller holes won't tear off in a breeze or wind.

DETAILED DESCRIPTION

Figure 1:
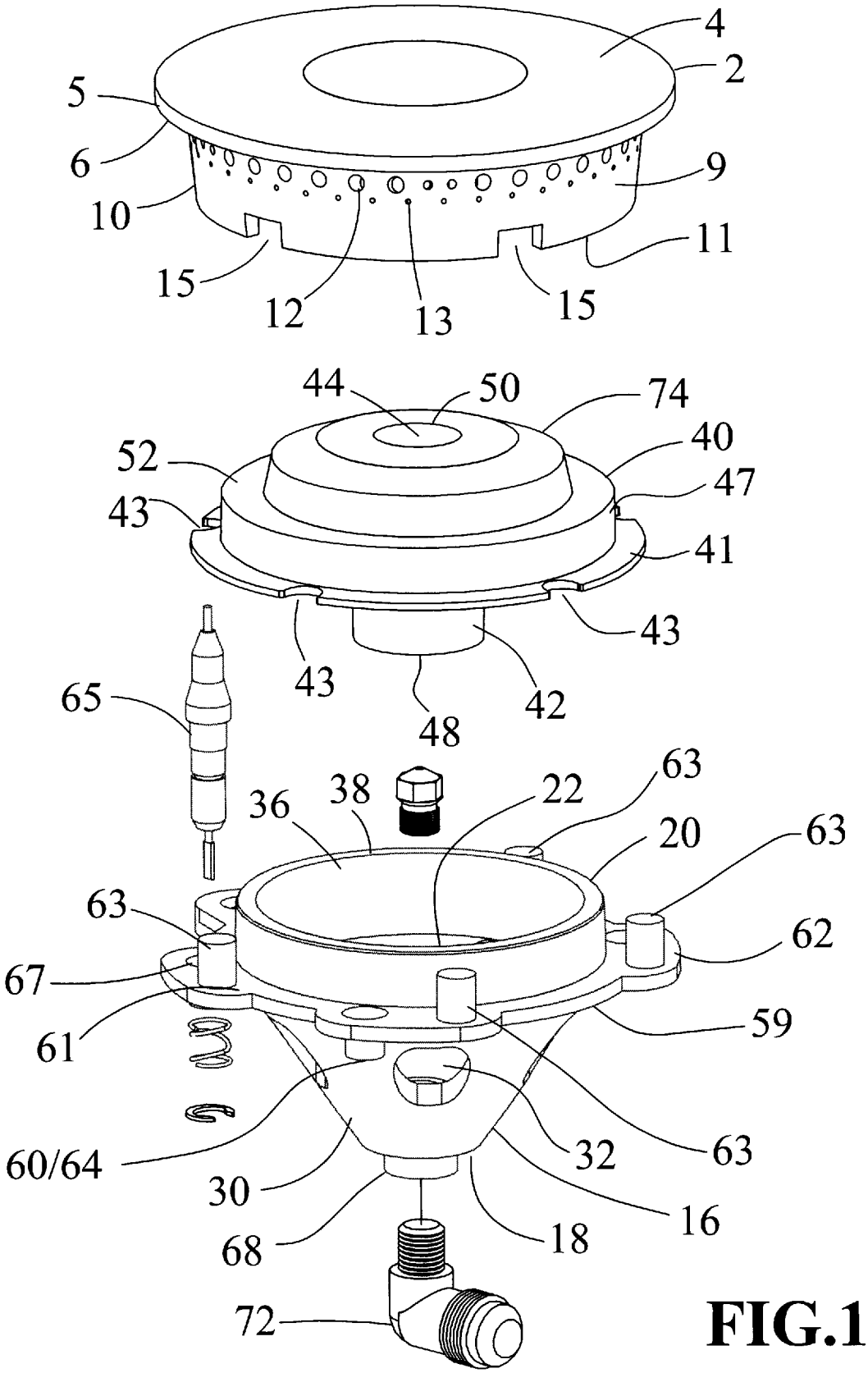
FIG. 1 shows an exploded view of the burner assembly.
Figure 2:
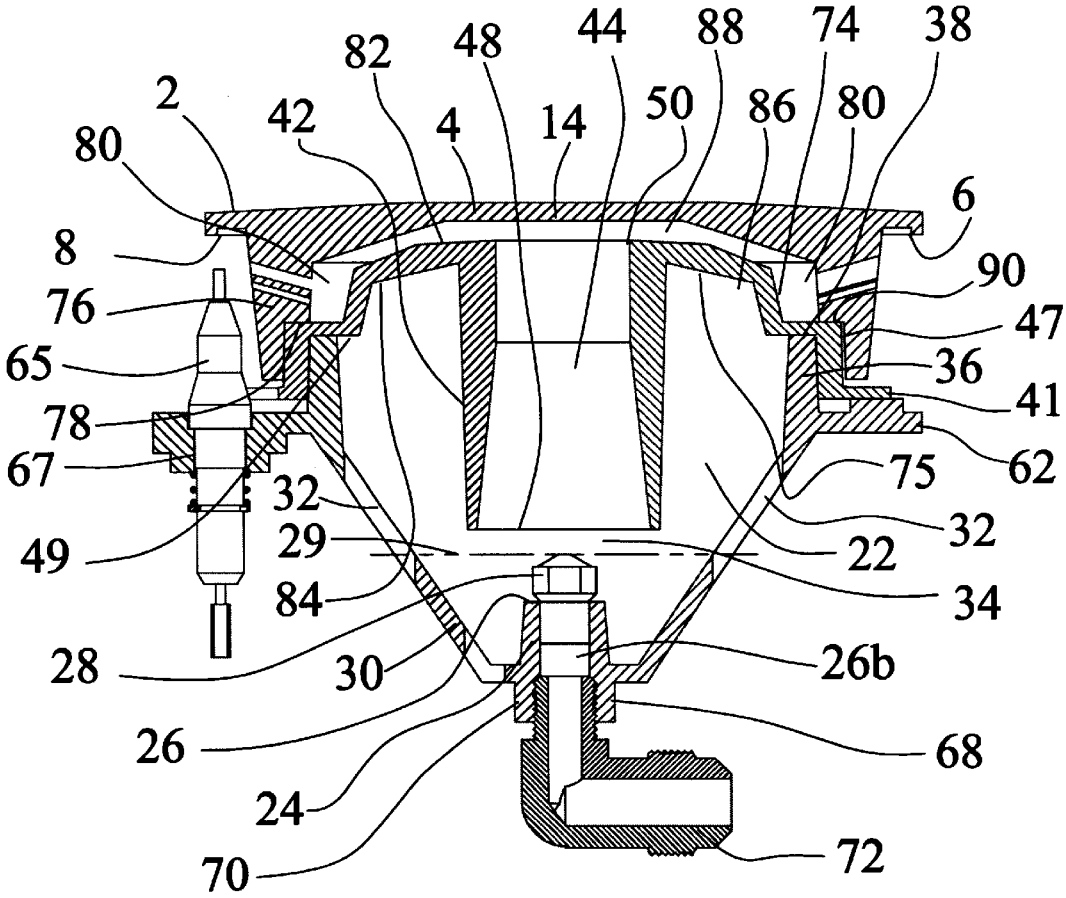
FIG. 2 is a cross section of the side elevation showing the burner base, the burner head, and the burner cap.
Figure 3:
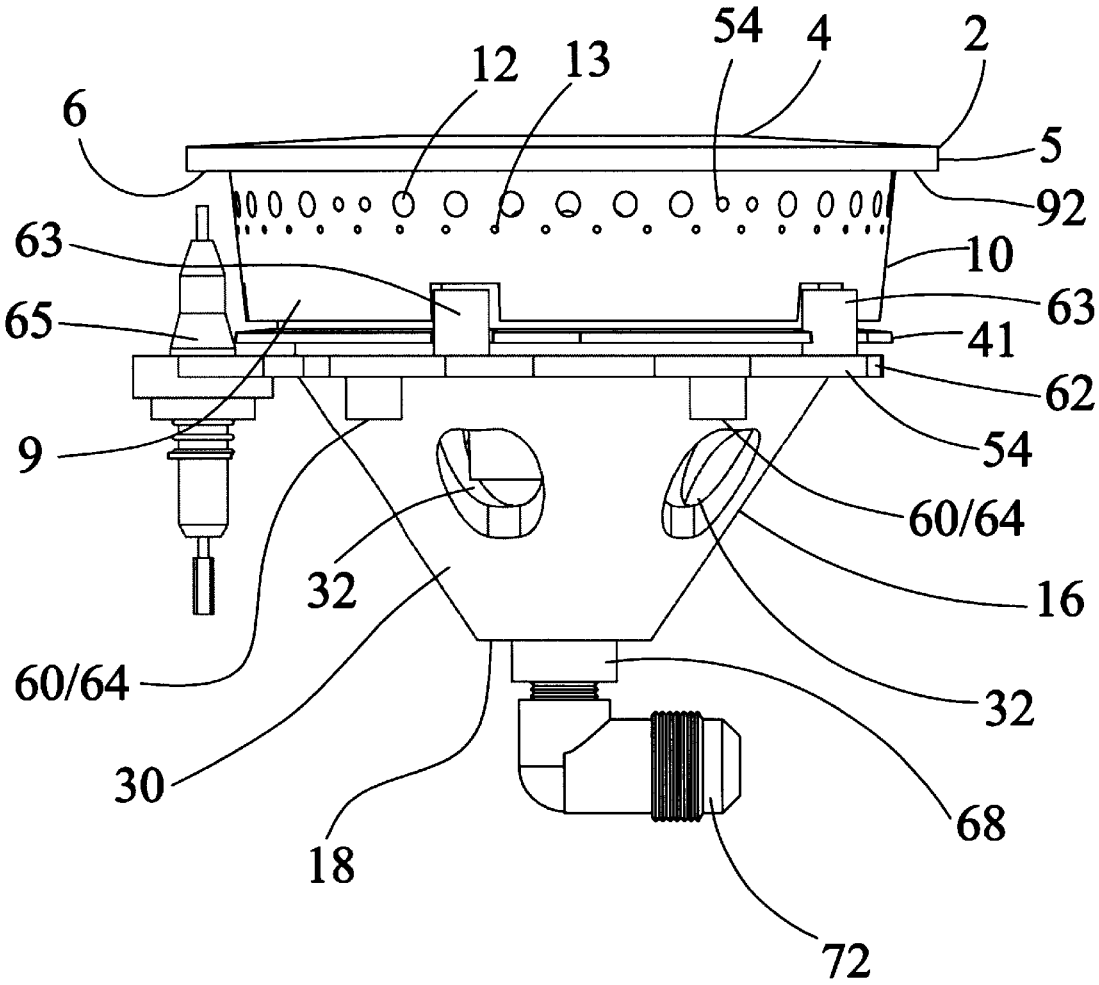
FIG. 3 is a side elevation of the burner assembly showing the burner base, the burner head and the burner cap in their respective positions.
Figure 4:
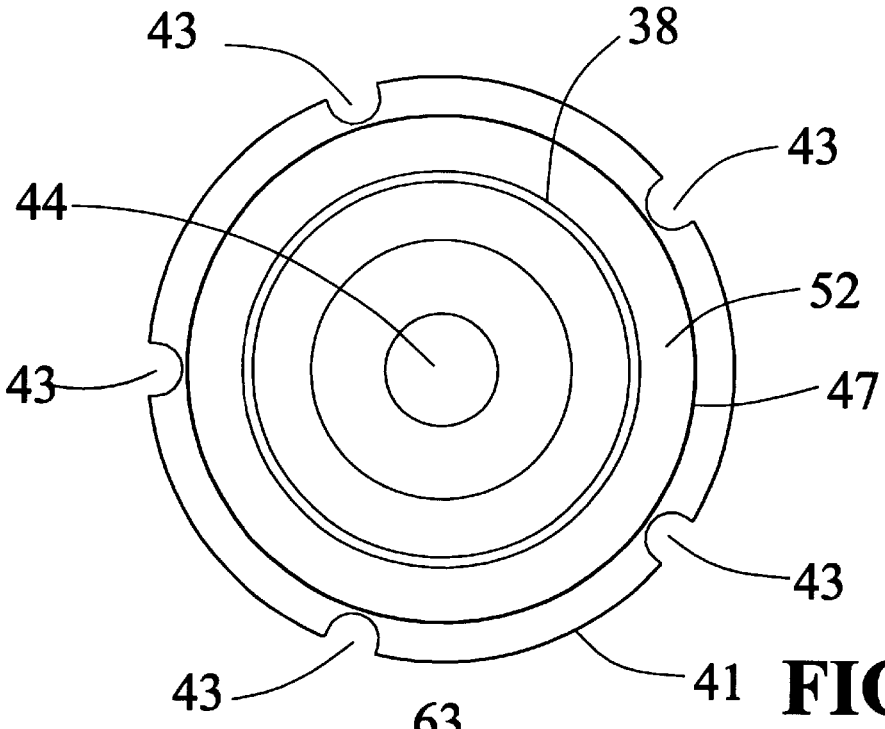
FIG. 4 is a top view of the burner head.
Figure 5:
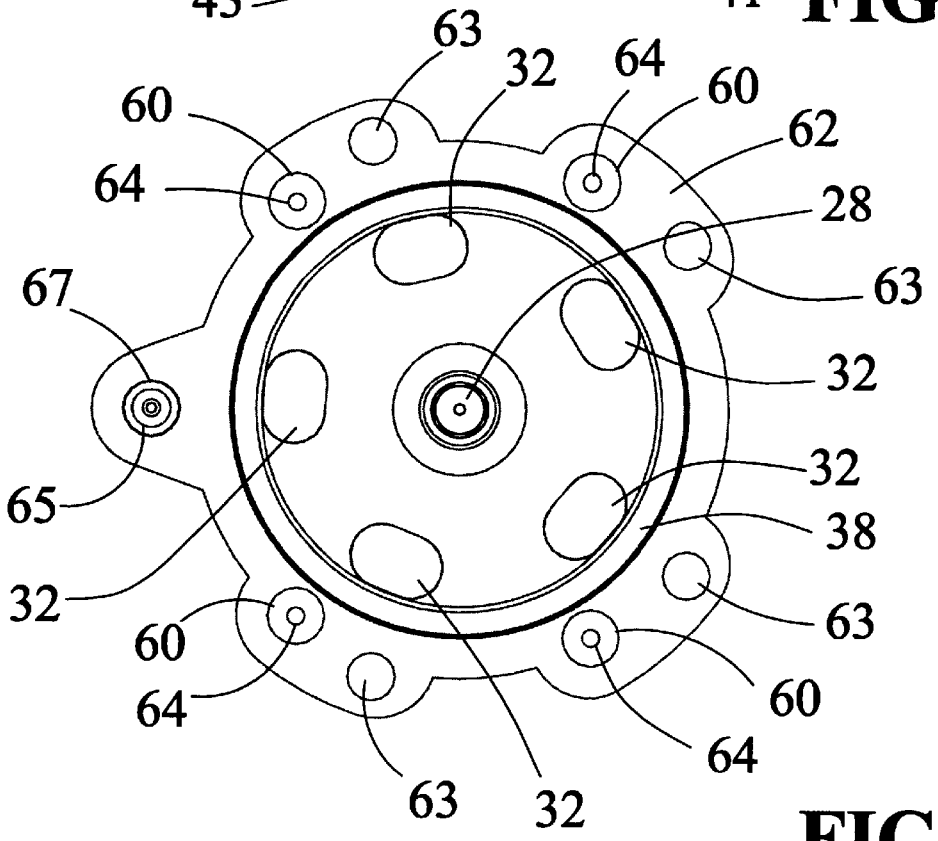
FIG. 5 is a top view of the burner base, looking into the cavity of the burner base.

The burner assembly (1) for this invention includes a burner base (16), the burner base (16) being made generally in a conical shape, having an apex (18) and a base (20). The burner base (16) is positioned inverted with the base (20) pointing upwards and the apex (18) pointing downwards. The burner base (16) is hollow having a constant wall thickness, thus defining a cavity (22) therein. The apex (18) of the burner base (16) has a first boss (68) that projects downwards. The first boss (68) has a hollow portion (70) centrally located. The hollow portion (70) is internally threaded, by which means for injecting flammable gas may be threadably attached, thus allowing the flammable gas to be injected into the burner assembly (1). Inside the cavity (22) is a second boss (24), having a top side (26) projecting slightly upwards from the burner base (16). The second boss (24) is located co-incident with the first boss (68). A jet (28) is installed onto the top side (26) of the second boss (24). The second boss (24) has a hollow portion **(26*b*) defined therein that is coincident with the hollow portion (70) of the boss (68), thereby allowing the injected flammable gas to pass through a connector means (72) and through the apex (18) into the hollow tube (24), through the jet (28) and into the cavity (22) of the burner base (16)**.

The top of the jet (28) defines a horizontal plane (29) and provides a high pressure stream of gaseous fuel into the cavity (22) of the burner base (16). A wall (30) of the burner base (16) has holes (32) or slots cut vertically into the wall (30) of the burner base (16), providing a ring shaped passage from the outer environment to the cavity (22) of the burner base (16). The size of the holes (32) in the burner (16) base are cut so as to not exceed the height of the jet (28), or the horizontal plane (29) defined by the top surface of the jet (28). This assures that there is no direct line from an outside airstream to the jet (28). By making the dimensions of the holes (32) or slots smaller than the height of the jet (28), disruption of the flow of gas to a burner cap (2) is prevented. The holes or slots (32) provide openings, which allows primary air into the burner base (16) and mixes with the flammable gas to provide a good stoichiometric gas-air mixture.

The burner base (16) has material extending outwardly from the burner base (16) defining a horizontal land or flange (62). The horizontal land or flange (62) provides a surface to firmly connect the burner base (16) to a chassis of a cooking appliance, such as a grill top or range top, by fastening means such as screws, bolts, or rivets by means of a hole (64) in each of a multiplicity of feet (60) circumferentially arranged on a bottom surface (59) of the horizontal land (62). The horizontal land or flange (62) additionally has a hole (67) defined therein to provide a location for an ignition means such as an ignitor (65) for the stoichiometric gas-air mixture. The horizontal land or flange (62) has an upper surface (61) with a plurality of locating bosses (63) located thereon.

The appliance has a hole defined coincident with the cavity in the conical burner base therein, thus providing a passageway from the burner base (16) below, through the appliance. The burner base (16) has an annular ring (36) that extends upward and penetrates through the appliance top, creating a land (38) for a burner head (40) to rest upon.

The burner head (40) is essentially a horizontal plate that has a first cylindrically raised portion (47), and a second cylindrically raised portion (74). The second cylindrically raised portion (74) is located on top of the first cylindrically raised portion (47). The first cylindrically raised portion (47) and second cylindrically raised portion (74) are centrally positioned. The second cylindrically raised portion (74) is smaller in diameter than said first cylindrically raised portion (47) and projects upward from said first cylindrically raised portion (47) thereby being taller than said first cylindrically raised portion (47). The first cylindrically raised portion (47) is smaller in diameter than said burner head (40) and provides a ledge (52) for the burner cap (2) to rest upon. The burner head (40) has an outer edge (41), the outer edge (41) has a plurality of slots (43) defined therein, said plurality of slots (43) equals the number of plurality of locating bosses (63) located on the burner base (16). An annular boss (42) is centrally located on a bottom surface (75) of said second cylindrically raised portion (74) wherein said annular boss (42) extends downwards. When the burner head (40) is positioned on said burner base (16), the annular boss (42) is positioned above the jet (28) and is positioned away from the jet (28) defining a gap (34) therebetween. The annular boss (42) has a hole (44) defined therein that extends upward and penetrates through said second cylindrically raised portion (74) of a top side (46) of the upper portion of the burner head (40). The hole (44) in the annular boss (42) could be cylindrical, or as in the invention here tapered, where a lower portion (48) has a hole diameter greater than a hole diameter in an upper portion (50) of the annular boss (42). The first cylindrically raised portion (47) has a bottom surface (49) where said bottom surface (49) is essentially flat. The bottom surface (49) of the first cylindrically raised portion (47) rests upon the land (38) on the burner base (16). The second cylindrically raised portion (74) has a first upper surface (82). The first upper surface (82) being smooth and having no depressions in which water or dirt could collect. The burner cap (4) and the first upper surface (82) of the burner head (1) create a dispersion chamber (88) therebetween. The bottom surface (49) and the second inner surface (84), and the annular boss (42) create a first cavity (86) therebetween.

The burner cap (2) has an essentially horizontal surface (4), the essentially horizontal surface (4) being smooth and having no depressions in which water or dirt could collect, wherein the essentially horizontal surface (4) has an outer edge (5). The burner cap (2), has a bottom surface (92), an annular burner ring (10) that extends downwards from the bottom surface (92) of the burner cap (2). The annular burner ring (10) is smaller in diameter than the outer edge (5) of the essentially horizontal surface (4). The annular burner ring (10) has a bottom surface (11) said bottom surface (11) of said annular burner ring (10) has a multiplicity of locating slots (15), said multiplicity of locating slots (15) being generally equally spaced around the annular burner ring (10). The outer edge (5) of said essentially horizontal surface (4) has a down turned flange or lip (6), said down turned lip (6) overhangs the outer edge of the burner cap (2). Just inside the down turned lip (6), an annular groove (8) has been carved into the burner cap (2). Said annular groove (8) is situated between said down turned lip (6) and said annular burner ring (10) The burner cap (2) has an inner top surface (14) where the inner top surface (14) may be parallel to the second cylindrically raised portion (74) of the burner head (40). An internal ledge (76) extends downwards and provides a mounting surface (78) for the burner cap (2). The internal ledge (76) has a second bottom surface (90) that rests upon the ledge (52) of the first cylindrically raised portion (47) of the burner head (40) creating a mixing cavity (80) therebetween.

The annular burner ring (10) has an outer surface (9), where situated on the outer surface (9) of the annular burner ring (10) are a multiplicity of large holes (12), series of pairs of secondary main holes (54), and a multiplicity of small holes (13). The multiplicity of small holes (13) are situated below the multiplicity of large holes (12), and the series of pairs of secondary main holes (54) are located between a pair of the multiplicity of large holes (12). The multiplicity of small holes (13), the multiplicity of large holes (12), and the series of pairs of secondary main holes (54) penetrate through the burner ring (10). A stoichiometrically correct gas-air mixture penetrates through the multiplicity of large holes (12), the multiplicity of smaller holes (13), and the series of pairs of secondary main holes (54) creating a flame means, said flame means is ignited by the ignitor (65) and sustained by a support flame. The multiplicity of larger holes (12) and smaller holes (13) penetrating through the burner ring (10) additionally provide enough gas-air mixture to be captured within the annular groove (8) and sustain the support flame located within the annular groove (8).

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. A burner assembly for outdoor cooking comprising:

a. a burner base, said burner having a base and an apex, said apex pointing downwards, said burner base additionally having an annular ring, said annular ring providing a raised edge to receive a burner head, said burner base further having an interior cavity defined therein, said apex having a first boss and a second boss, said first boss projecting downwards from said apex, said second boss being located within said cavity of said burner base and projecting upwards from said apex of said burner base, said first boss and said second boss being located coincident to each other, said first boss and said second boss each having a hollow portion defined therein, said hollow portion of said first boss and said hollow portion of said second boss being coincidentally located to allow a flammable gas to pass therethrough, a connector means is attached to said first boss, and a jet means is attached to said second boss;

b. said burner base having a multiplicity of slots, said slots providing passage for drawing primary air into said interior cavity of said burner base, said slots being below an upper edge of said jet means, said burner base having a horizontal land, said bottom surface of said horizontal land having a multiplicity of feet circumferentially defined thereon, said multiplicity of feet having holes defined therein for mounting said burner base onto a chassis of a cooking appliance, said horizontal land having an upper surface, said upper surface having a plurality of locating bosses defined thereon;

c. a burner head, said burner head having a first cylindrically raised portion and a second cylindrically raised portion, said second cylindrically raised portion being smaller in diameter than said first cylindrically raised portion, said second cylindrically raised portion being positioned on top of said first cylindrically raised portion, said first cylindrically raised portion having a bottom surface, said bottom surface of said first cylindrically raised portion resting on said annular ring of said burner base, said first cylindrically raised portion of said burner head defining a ledge to receive an annular burner ring defined on a burner cap;

d. said burner cap and first cylindrically raised portion of said burner head defining a mixing cavity therebetween, said top surface of said burner head additionally being smooth and having no depressions in which water or dirt could collect, a bottom surface of said second cylindrically raised portion of said burner head has an annular boss extending downwards, said annular boss being positioned above said jet means, said annular boss further having a hole defined therein, said hole of said annular boss extending upward and penetrating through said second cylindrically raised portion of said burner head, said burner head further having an outer edge at a base of said burner head, said flange having a plurality of slots complementary to said plurality of locating bosses on said burner base to correctly position said burner head on said burner base; and e. said burner cap having an outer edge, said outer edge having a flange projecting downwards from said outer edge of said burner cap defining a downturned lip, said burner cap having an annular ring, said annular ring projecting downward from a bottom surface of said burner cap, said annular ring having a flame means defined therein, said flame means being ignited by an ignition means, said downturned lip of said burner head has an annular groove defined therein, said annular groove collecting a flammable gas-air mixture, said annular groove being above said flame means in said burner ring, said flammable gas-air mixture being captured in said annular groove and providing gas for a supporting flame when ignited in said annular groove under said ledge of said annular burner cap, said annular burner ring having locating means, said supporting flame providing continuous ignition of said flame means, said downturned lip additionally allowing dirt and fluid to drip away from said supporting flame preventing said supporting flame from being extinguished.

2. A burner assembly according to claim 1 wherein said burner head, and said burner cap are separate components, said burner head loosely fitting onto said burner base, said burner cap fitting loosely onto said burner head.

3. A burner assembly according to claim 1 wherein said flame means consists of;

a. said outer surface of said annular burner ring having a multiplicity of large holes circumferentially arranged around an outer surface, said outer surface of said annular burner ring also containing a multiplicity of small holes positioned below said multiplicity of large holes, said outer surface of said annular burner ring also having a multiplicity of pairs of secondary main holes situated between said large holes, said multiplicity of large holes, said multiplicity of small holes and said multiplicity of pairs of secondary main holes communicating with said mixing cavity defined between said burner head and said burner cap, allowing a gas-air mixture passing from said gap between said burner head and said burner cap to create a main flame, when ignited.

4. A burner assembly according to claim 1 wherein said locating means for said burner cap consists of a multiplicity of locating slots circumferentially arranged on a lower surface of said annular burner ring, said locating slots being complementary to said multiplicity of locating bosses positioned on said burner base, so that when said burner cap is placed on said burner head, said burner cap is correctly positioned.

5. A burner assembly according to claim 1 wherein said ignition means consists of an ignitor.

6. A burner assembly according to claim 1 wherein said burner base has a conical shape.

* * * * *